US005083325A

United States Patent [19]

Vitullo

[11] Patent Number: 5,083,325

[45] Date of Patent: Jan. 28, 1992

[54] COMMODE TRAINING APPARATUS

[76] Inventor: Joseph Vitullo, 2800 Tracy Blvd. #35, Tracy, Calif. 95376

[21] Appl. No.: 554,564

[22] Filed: Jul. 19, 1990

[51] Int. Cl.[5] ..... A47K 11/04

[52] U.S. Cl. ..... 4/479

[58] Field of Search ..... 4/449, 458, 474–477, 4/479, 483, 300.1

[56] References Cited

U.S. PATENT DOCUMENTS

| | | | |
|---|---|---|---|
| 1,498,874 | 6/1924 | Hopkins | 4/458 |
| 2,307,897 | 1/1943 | Overholser | 4/478 |
| 2,552,002 | 5/1951 | Dunbar | 4/478 X |
| 2,923,950 | 2/1960 | Carter | 4/483 X |
| 2,930,612 | 3/1960 | Goodrich | 4/479 X |
| 4,513,923 | 4/1985 | Ulics | 4/300.1 |
| 4,785,483 | 11/1988 | Wise | 4/752 R |

*Primary Examiner*—Charles E. Phillips
*Attorney, Agent, or Firm*—Leon Gilden

[57] ABSTRACT

An apparatus configured to simulate an automobile, including a platform with a seat platform mounted thereon, with the platform including a forward and a rear platform, with the forward platform removably mounting roll support plates to rotatably mount a tissue rolled thereon. The seat support platform including a cylindrical cavity to selectively receive a commode insert therewithin. The rear platform of the apparatus may further include a trunk cavity to provide storage for the commode insert and roll support plates during periods of non-use.

3 Claims, 4 Drawing Sheets

FIG 1
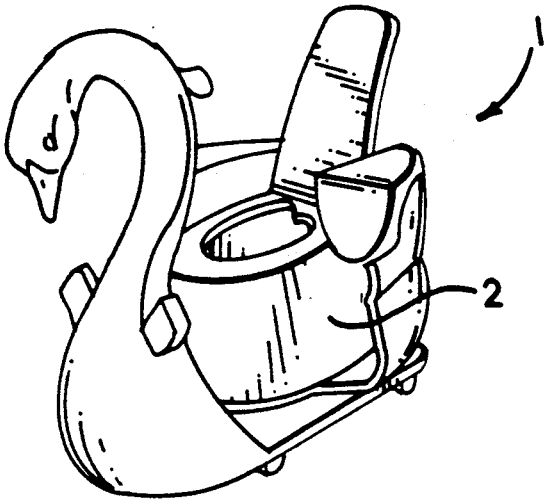
PRIOR ART
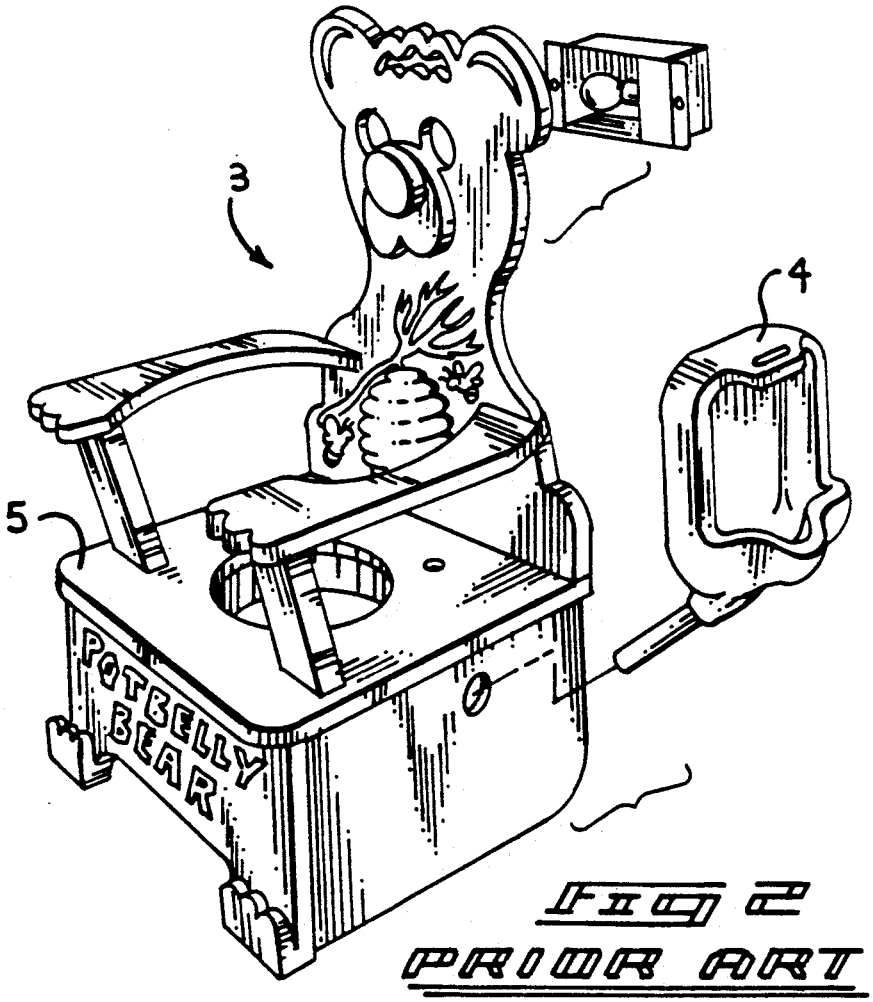
FIG 2
PRIOR ART 16a
16
10
15
13
18
14
17
12
34
17
25
20
15a
11
19

16
18
20

COMMODE TRAINING APPARATUS

BACKGROUND OF THE INVENTION

1. Field of the Invention

The field of invention relates to commode training apparatus, and more particularly pertains to a new and improved commode training apparatus wherein the same permits simulation of an automobile to enhance use of and acceptance by a child in a commode training procedure.

2. Description of the Prior Art

Commode training apparatus of various types have been utilized in the prior art. Typically, such apparatus is desired in enhancing utilization and acceptance by children in a commode training scenario. Examples of prior art commode training apparatus includes U.S. Pat. No. 2,446,381 to Middleton wherein a toilet seat arrangement is configured as a riding saddle to enhance acceptance by a child.

U.S. Pat. Nos. Des. 210,581; 276,361; 241,251; and 242,456 set forth various configurations of a commode for use by children, wherein the patents fail to provide an organization that may be utilized as a toy and a training forum for use by children.

As such, it may be appreciated that there continues to be a need for a new and improved commode training apparatus which addresses both the problems of ease of use as well as effectiveness in construction and in this respect, the present invention substantially fulfills this need.

SUMMARY OF THE INVENTION

In view of the foregoing disadvantages inherent in the known types of commode training apparatus now present in the prior art, the present invention provides a commode training apparatus wherein the same sets forth a simulation of an automobile and various operative components thereof to enhance acceptance of and use by a child in a toilet training procedure. As such, the general purpose of the present invention, which will be described subsequently in greater detail, is to provide a new and improved commode training apparatus which has all the advantages of the prior art commode training apparatus and none of the disadvantages.

To attain this, the present invention provides an apparatus configured to simulate an automobile, including a platform with a seat platform mounted thereon, with the forward platform removably mounting roll support plates to rotatably mount a tissue rolled thereon. The seat support platform including a cylindrical cavity to selectively receive a commode insert therewithin. The rear platform of the apparatus may further include a trunk cavity to provide storage for the commode insert and roll support plates during periods of non-use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode training apparatus which has all the advantages of the prior art commode training apparatus and none of the disadvantages.

It is another object of the present invention to provide a new and improved commode training apparatus which may be easily and efficiently manufactured and marketed.

It is a further object of the present invention to provide a new and improved commode training apparatus which is of a durable and reliable construction.

An even further object of the present invention is to provide a new and improved commode training apparatus which is susceptible of a low cost of manufacture with regard to both materials and labor, and which accordingly is then susceptible of low prices of sale to the consuming public, thereby making such commode training apparatus economically available to the buying public.

Still yet another object of the present invention is to provide a new and improved commode training apparatus which provides in the apparatuses and methods of the prior art some of the advantages thereof, while simultaneously overcoming some of the disadvantages normally associated therewith.

Still another object of the present invention is to provide a new and improved commode training apparatus wherein the same permits use and operation of the organization as a toy, and alternatively as a commode training organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art commode training apparatus.

FIG. 2 is an isometric illustration of a further prior art commode training apparatus.

DESCRIPTION OF THE PREFERRED EMBODIMENT

Figure 3:
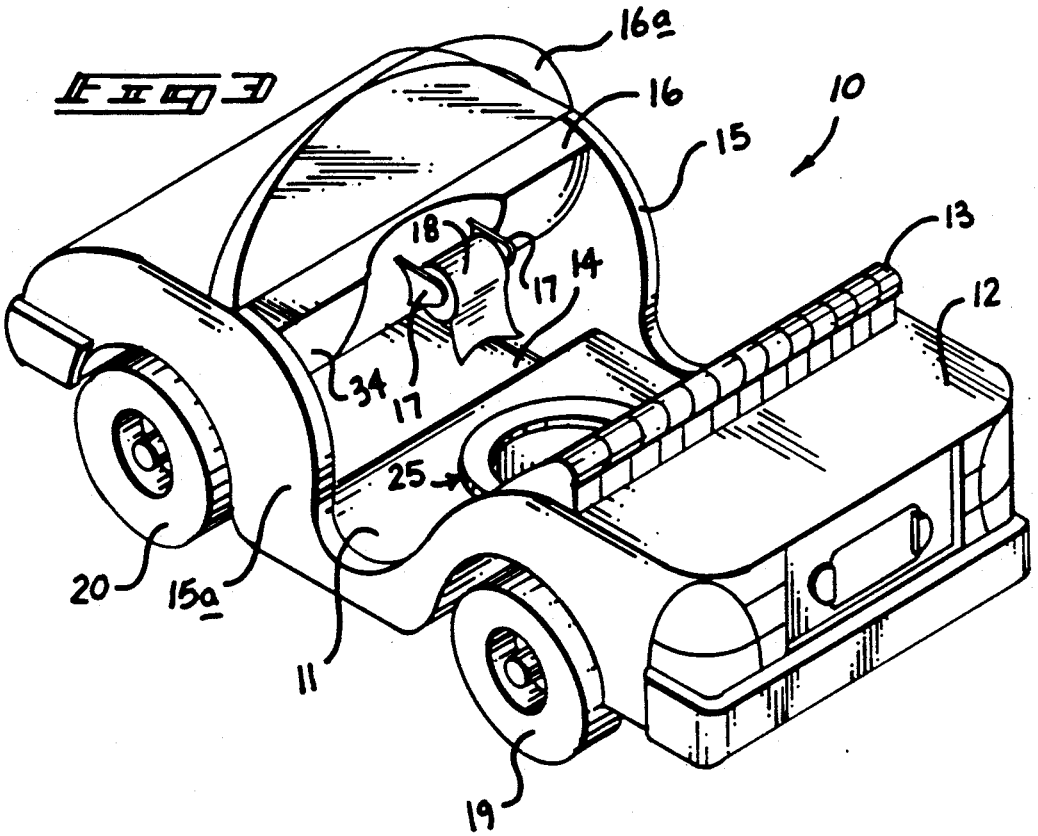
FIG. 3 is an isometric illustration of the instant invention.
Figure 4:
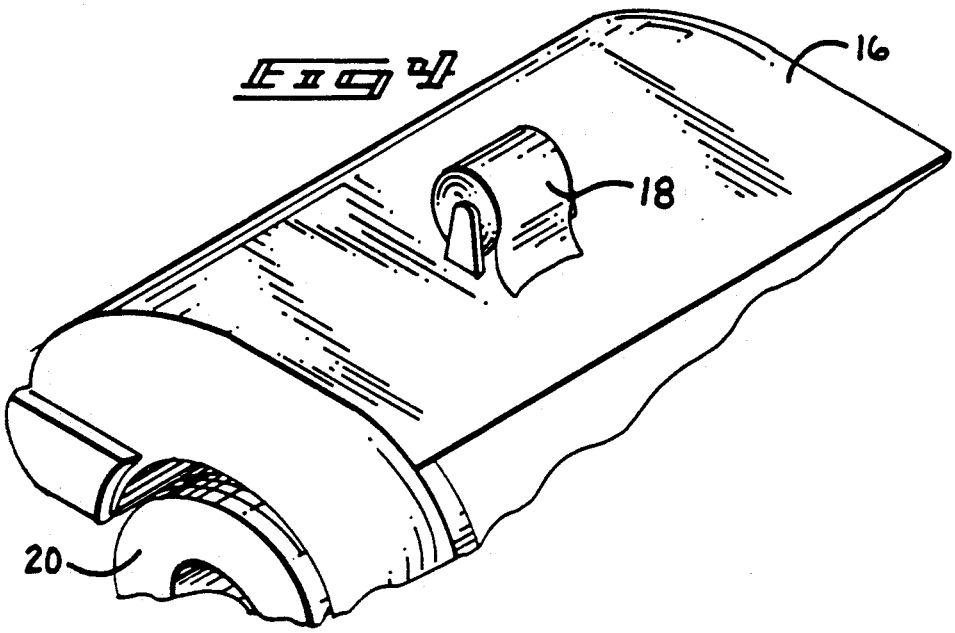
FIG. 4 is an isometric illustration of the instant invention with the tissue roll supporting construction on the forward platform.

With reference now to the drawings, and in particular to FIGS. 1 to 8 thereof, a new and improved commode training apparatus embodying the principles and concepts of the present invention and generally designated by the reference numerals 10 and 10*a* will be described.

FIG. 1 illustrates a prior art commode training organization 1, wherein a commode 2 is mounted within a simulation of a swan-like figure. FIG. 2 illustrates a further commode training organization 3, including a removable urinal assembly 4 and may be mountably secured to the commode seat construction 5 of the prior art device.

More specifically, the commode training apparatus 10 of the instant invention essentially comprises a vehicular simulation that includes a horizontal seat platform 11 overlying a support platform 14 in a generally parallel relationship. A rear support shelf 12 extends generally parallel to, rearwardly, and spaced above the seat platform 11. A forward platform 16 spaced forwardly of and generally aligned with the rear support shelf 12 to include an optional removable windshield 16*a*. In the configuration, as illustrated in FIG. 3, a plurality of roll support plates 17 are mounted to a dashboard panel 34 to rotatably mount a tissue roll 18 thereon. A vertical seat back support member 13 arranged generally orthogonally to the seat platform 11 provides a back rest for the seat platform 11 and is illustrated to rise above the rear support shelf 12. A rotatably mounted rear wheel pair 19 and a rotatably mounted forward wheel pair 20 are mounted underlying the respective rear support shelf 12 and the forward platform 16. The spaced side walls defining a right side wall 15 and a left side wall 15*a* include arcuate recesses for receiving the wheels of each wheel pair, with the side walls orthogonally arranged relative to the seat platform 11 and the rear support shelf 12 and the forward platform 16, as well as the support platform 14. A cylindrical commode insert is removably mounted within a commode cavity (see FIG. 6 for example) directed medially through the seat platform 11. The cylindrical commode insert includes an upper annular flange 26 rotatably mounted to a lower annular flange 28, with the lower annular flange 28 orthogonally and integrally mounted to an upper terminal end of the cylindrical cup-shaped member 27 defining the commode insert to include a swivel bearing 29 between the upper and lower annular flanges. The swivel bearing 29 includes an annular array of roller bearings to permit a child to swivel upon the upper annular flange to enhance ease of visibility during use of the organization while not disturbing a child's orientation upon the upper annular flange 26.

Figure 5:
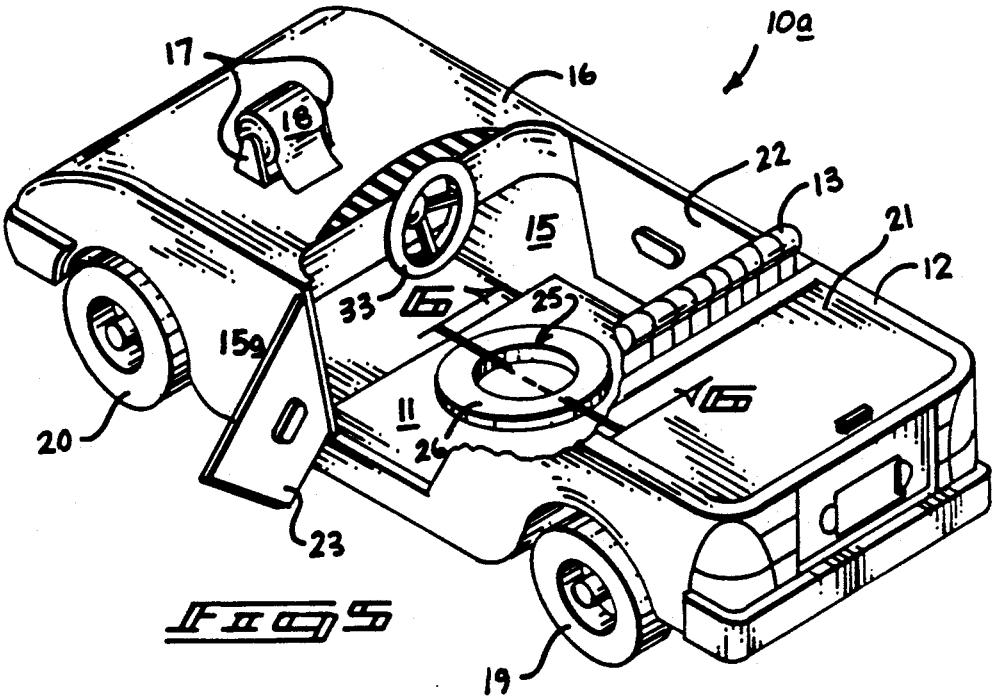
FIG. 5 is an isometric illustration of a modification of the instant invention.
Figure 6:
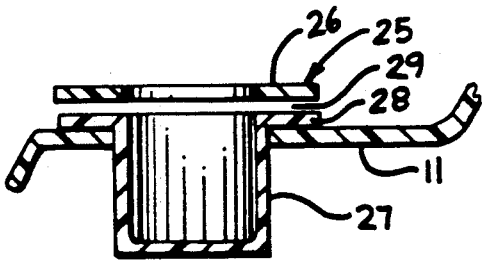
FIG. 6 is an orthographic view, taken along the lines 6-6 of FIG. 5, in the direction indicated by the arrows.
Figure 7:
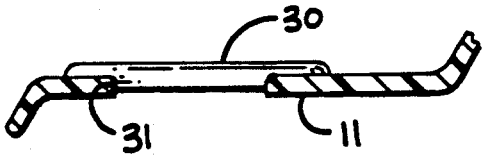
FIG. 7 is an orthographic cross-sectional illustration of a replacement seat cap mounted overlying the commode cavity of the organization.
Figure 8:
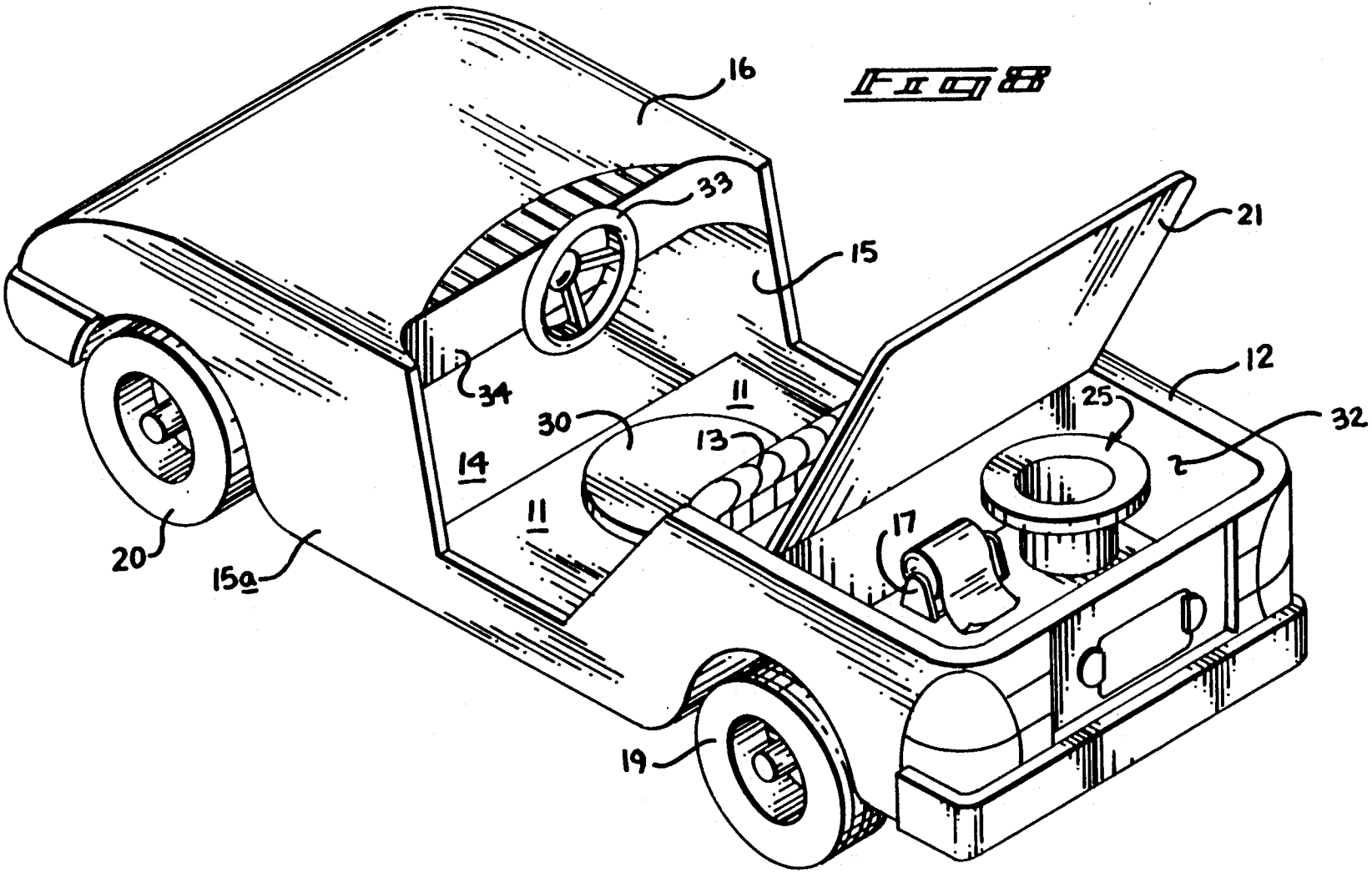
FIG. 8 is an isometric illustration of the invention with the rear lid in a raised orientation relative to an associated trunk cavity.

If desired, a left door 23 and a right door 22 are removably and hingeably mounted to the respective left and right side walls 15*a* and 15 respectively, in a manner as illustrated in FIG. 5 for example, to permit a child to retain a level of privacy during use of the organization. Further, the rear support shelf 12 may include a pivotally mounted rear lid 21 (see FIG. 5) as illustrated in the embodiment as set forth as 10*a*. The rear lid 21 overlies a trunk cavity 32 (see FIG. 8) that may house and store the various components of the organization. As illustrated, the roll support plate 17 may be mounted upon the dashboard panel 34 or upon the forward platform 16 for ease of use by a child when a steering wheel 33 is mounted upon the dashboard panel 34. Upon removal of the commode insert 25, a seat cap 30 including an annular projection 31 coaxially and integrally mounted to a bottom surface of the seat cap 30 may be mounted overlying the commode cavity of the rear support shelf 12 to provide a support seat for use of the organization as a toy.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode training apparatus comprising, in combination, a support platform, the support platform including a seat platform spaced above the support platform of a generally parallel relationship, and a forward platform spaced above the support platform and the seat platform forwardly of the seat platform, and a rear support shelf arranged in a spaced relationship above the seat platform rearwardly thereof generally aligned with the forward platform, and an annular commode cavity positioned medially of the seat platform, and a commode insert removably mounted relative to the commode cavity, and including a plurality of roll support plates, the roll support plates removably mounted to the forward platform, with the roll support plates including a tissue roll rotatably mounted therebetween, and further including a right side wall spaced from and parallel to a left side wall, with the right and left side walls arranged orthogonally relative to the forward platform, support platform, seat platform, and rear support shelf and extending coextensively thereto, and wherein the right and left side walls each include a door opening, and each door opening includes a respective right and left door removably mounted relative to the respective right and left side wall, and wherein the commode insert is cylindrical and includes a cylindrical cup-shaped member, with a lower annular flange orthogonally mounted to an upper end of the cup-shaped member, and an upper annular flange rotatably mounted relative to the lower annular flange, with a swivel bearing member mounted between the upper and lower annular flange to permit rotation of the upper annular flange relative to the annular flange, and further including a seat cap, with the seat cap including an annular projection coaxially and integrally mounted to a lower surface of the seat cap, with the annular projection receivable within the commode cavity upon removal of the commode insert, and wherein the rear support shelf includes a pivotally mounted rear lid, with the pivotally mounted rear lid overlying a trunk cavity, with the trunk cavity arranged for selective storage of the commode insert and the roll support plates during periods of non-use.

2. An apparatus as set forth in claim 1 wherein the forward platform includes a vertical dashboard panel obliquely mounted to a rear end edge of the forward platform and extending downwardly therefrom, with the dashboard panel including a steering wheel medially mounted of the dashboard panel for amusement and diversion of a child utilizing the commode insert.

3. An apparatus as set forth in claim 2 further including a forward and rear pair of wheels rotatably mounted to the support platform.

* * * * *